US005414901A

United States Patent [19]

Srámek

[11] Patent Number: 5,414,901

[45] Date of Patent: May 16, 1995

[54] DEVICE FOR SEVERING THE SLIVER IN A FILLING STATION OF A TEXTILE MACHINE

[75] Inventor: Rudolf Srámek, Liberec, Czechoslovakia

[73] Assignees: Elitex Usti Nad Orlici S.P.; Textilnich Stroju A.S., both of Czechoslovakia

[21] Appl. No.: 134,551

[22] Filed: Oct. 8, 1993

[30] Foreign Application Priority Data

Oct. 8, 1992 [CS] Czechoslovakia ..... 3072-92

[51] Int. Cl.[6] ..... D01G 27/00

[52] U.S. Cl. ..... 19/159 A

[58] Field of Search ..... 19/150, 159 R, 159 A, 19/160; 83/17, 18, 175, 913, 949, 950

[56] References Cited

U.S. PATENT DOCUMENTS

| | | | |
|---|---|---|---|
| 3,353,224 | 11/1967 | Gossett et al. | 19/159 A |
| 3,354,513 | 11/1967 | Fornes | 19/159 A |
| 3,381,342 | 5/1968 | Selby et al. | 19/159 A |
| 3,605,198 | 9/1971 | Mackie | 19/159 A |
| 3,656,383 | 4/1972 | Dibble et al. | 19/159 A X |
| 5,237,726 | 8/1993 | Gartenmann et al. | 19/159 A |

FOREIGN PATENT DOCUMENTS

| | | | |
|---|---|---|---|
| 0493340 | 7/1992 | European Pat. Off. | 19/159 A |
| 0522970 | 8/1970 | Japan | 19/159 A |
| 1436857 | 5/1976 | United Kingdom | 19/159 A |

*Primary Examiner*—Clifford D. Crowder
*Assistant Examiner*—Ismael Izaguirre
*Attorney, Agent, or Firm*—Ostrolenk, Faber, Gerb & Soffen

[57] ABSTRACT

A device for severing the sliver in a filling station for cans of a textile machine producing the sliver, upon the replacement of a full can by an empty one. The filling station comprises a sliver coiling device on which there is mounted, over the gap between the transferred full can and the can just beginning to receive the sliver, a sliver holding device and also a sliver grasping device which is reversibly movably mounted on the coiling device for the sliver to move with reference to the sliver holding device thereby to sever the sliver held between the grasping and holding device by movement of the grasping device.

14 Claims, 4 Drawing Sheets

DEVICE FOR SEVERING THE SLIVER IN A FILLING STATION OF A TEXTILE MACHINE

BACKGROUND OF THE INVENTION

FIELD OF THE INVENTION

The present invention relates to a device for severing a sliver in a filling station of a sliver producing textile machine after a full sliver can has been replaced by an empty one, and in which the filling station comprises a sliver coiling device.

The sliver produced by a textile machine, e.g. by a carding or drawing machine, is delivered into cans in the filling station. Cans of circular cross section are currently used and, in recent years, cans of non-circular cross section are also used. Use of non-circular cans appears to be advantageous especially from the point of view of automation of the production processes in the spinning mills.

When a full can is being replaced by an empty one, it is necessary to sever the sliver between the cans. This can be done for instance, as disclosed in DE OS 38 05 203, which corresponds to U.S. Pat. No. 4,997,738, by stopping the circular, revolving cans when they are full, then moving an arm to the sliver for grasping the sliver, severing it and laying it over the can edge. Alternatively, after partial displacement of the can, the sliver is severed under the can coiler and the sliver then freely falls over the can edge and is then inserted into the sliver holder of the can by means of another device.

Drawbacks of this apparatus are the necessity to interrupt the sliver coiling process, i.e., to stop the can coiler at a predetermined position, at which the arm grasps the sliver, as well as the complicated insertion of the sliver end into the sliver holder of the can.

These drawbacks are partly removed by a method and device according to Czech Patent Application No. 5448-90 in which, after the circular can is filled, the sliver is severed in a similar way and let to hang freely over the can edge. This device is simpler. But, the freely hanging sliver end can be damaged during handling of the cans, and the sliver can be drawn out of the can. Besides, this system cannot be applied to non-circular cans.

As described, for instance, in Czech Patent Application No. 2894-91, the non-circular cans are filled by a known sliver coiling device comprising an instrument for grasping the sliver and having a related mechanism for adapting the sliver end, the instrument being equipped with a mechanism for grasping the sliver between a full non-circular can located in the mechanism for adapting the sliver end and the sliver receiving non-circular can situated in the sliver coiling device. The sliver grasping device at the same time severs the sliver and transfers the thereby produced free end of the sliver from the full non-circular can into a device for creating a reinforced introductory point.

The special drawback of this device is its considerable complexity and the great distance between the sliver end adapting device and the can receiving the sliver, with the resulting difficulty of grasping the sliver.

SUMMARY OF THE INVENTION

The object of the invention is to do away with the drawbacks of the prior art and to provide a reliable device for severing the sliver in a filling station of a textile machine after the full can has been replaced with an empty one. The device should be applicable to a filling station containing non-circular cans or to a filling station containing circular cans.

The invention concerns a device for severing the sliver in a filling station of a sliver producing textile machine after a full can is replaced by an empty one. On the sliver coiling device, above the gap between the displaced full can and the other can that just begins to receive the sliver, there is provided a sliver holding device and a related sliver grasping device mounted in a reversibly adjustable way on the sliver coiling device.

In a preferred embodiment, the holding device comprises a holding plate fixed to the frame of the sliver coiling device and a holding lever, which is rotatably mounted on the frame of the sliver coiling device and in its active position, the holding lever bears on the holding plate.

Preferably, the grasping device comprises a gripper mounted in a reversibly adjustable way on the frame of the sliver coiling device. The gripper is provided with a feeler which registers the presence of the sliver.

In another preferred embodiment, the sliver coiling device comprises at least one searching lever, mounted for reversible rotation on the frame of the sliver coiling device. The end of the functional surface of the device has a receiving surface for an ancillary lever mounted for reversible rotation on the frame of the sliver coiling device.

Preferably, the grasping device also comprises a gripper mounted in a reversibly adjustable way on the frame of the sliver coiling device and the gripper has two related feelers for registering the position of the gripper.

It is advantageous to fix the gripper to a conveyor equipped with a reversing motor.

The gripper can be made as a body in which the rod is slidingly mounted. The tie rod is connected with a pneumatic cylinder and has a clip at its extremity.

Other features and advantages of the present invention will become apparent from the following description of the invention which refers to the accompanying drawings.

BRIEF DESCRIPTION OF THE DRAWINGS

Embodiments of the device according to this invention are shown schematically in the accompanying drawings in which.

DESCRIPTION OF THE PREFERRED EMBODIMENTS

Figure 1:
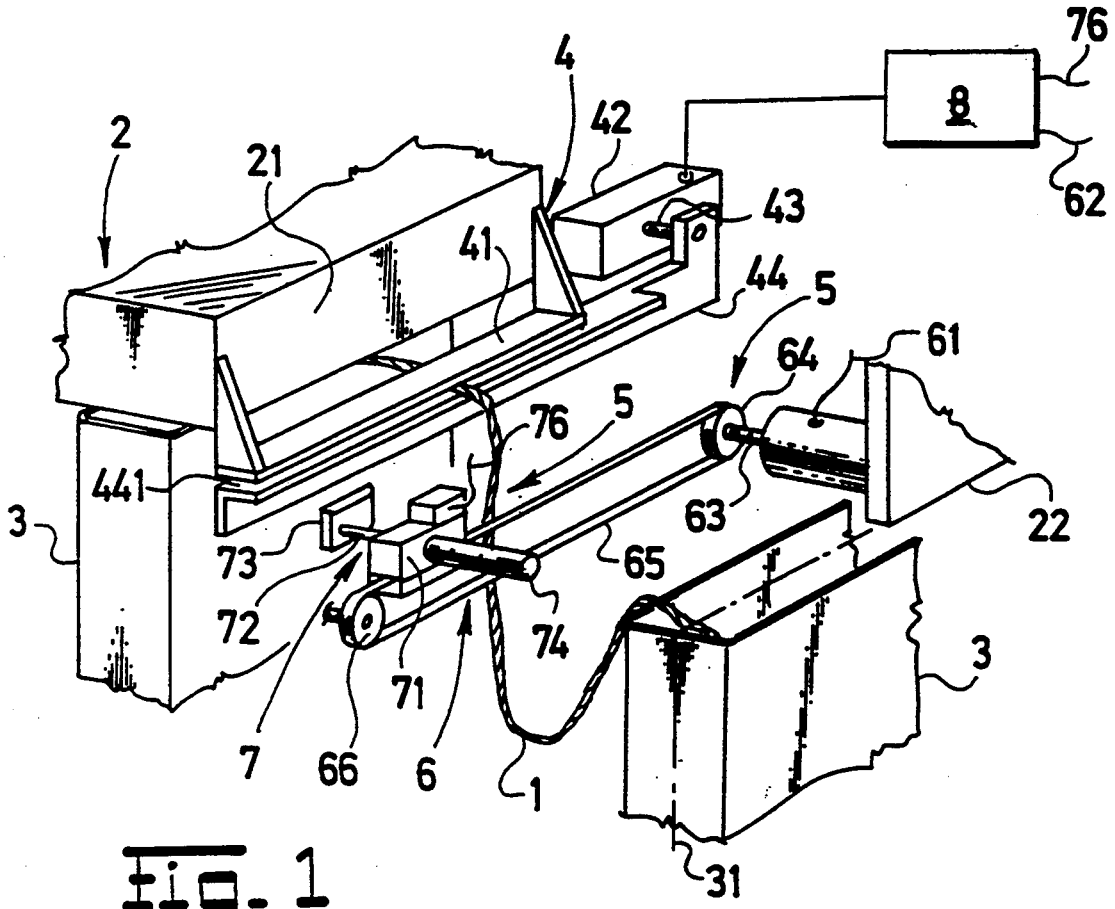
FIG. 1 is an axonometric view of a first embodiment of the invention with the sliver grasped by the holding device.

In the first embodiment, a sliver 1 is produced on a not illustrated textile machine, e.g., on a drawing or carding machine. In a known way, the sliver is led from the textile machine into a sliver coiling device 2. A sliver receiving non-circular can 3 is located under the coiling device. The can is seated in a not shown device for replacing a filled non-circular can 3 with an empty one. The non-circular cans 3 are positioned in such a manner that their respective long axis planes 31 are each perpendicular to the direction of the motion of the non-circular can 3 while the cans are being exchanged. In another not illustrated embodiment, the non-circular cans may be oriented differently.

The sliver coiling device 2 comprises a known, not shown can coiler which is mounted in a reversibly adjustable way parallel to the long axis plane 31 of each non-circular can 3.

The lateral side 21 of the sliver coiling device 2 carries a holding device 4 for the sliver 1. The holding device 4 can also be fixed to another section of the sliver coiling device 2. It is preferably oriented parallel to the long axis plane 31 of the non-circular can 3.

Figure 2:
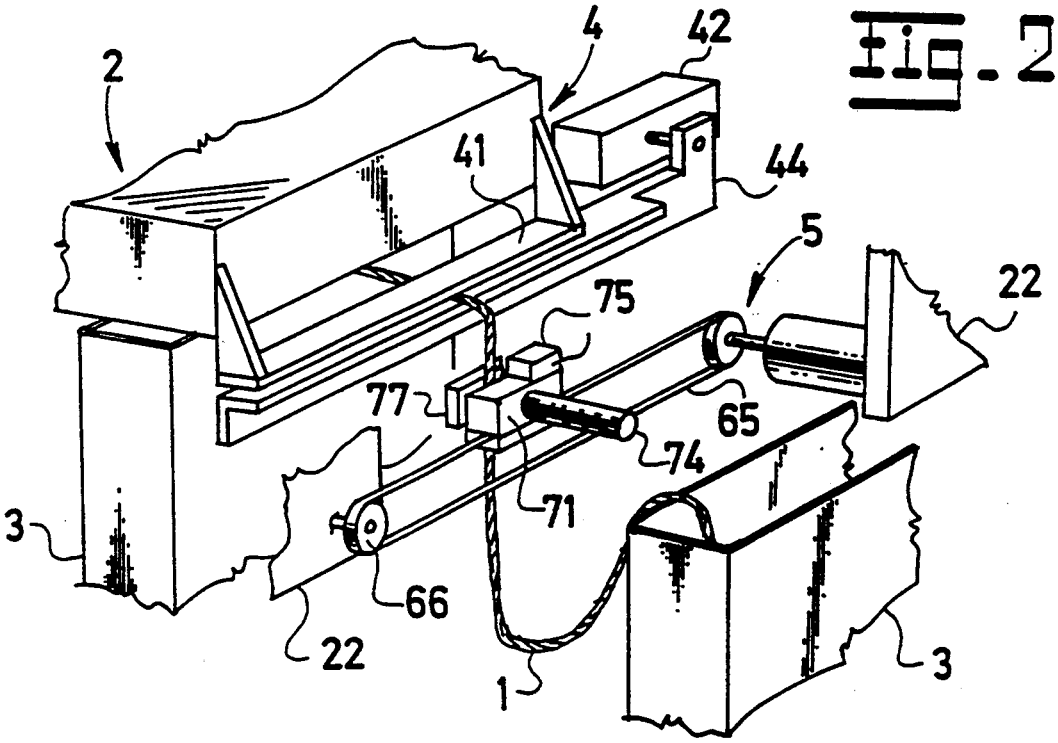
FIG. 2 shows the device of FIG. 1 in a subsequent stage in which the sliver is grasped by the gripper and fixed by the clip.
Figure 3:
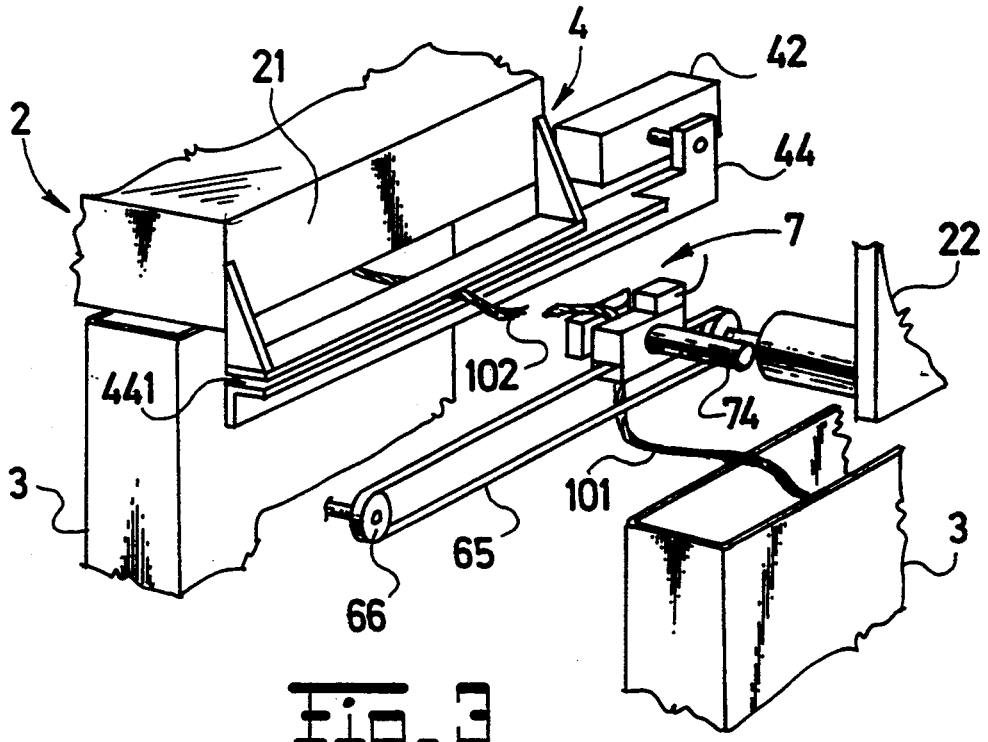
FIG. 3 shows a still further stage of the device of FIG. 2 after the sliver has been severed.
Figure 4:
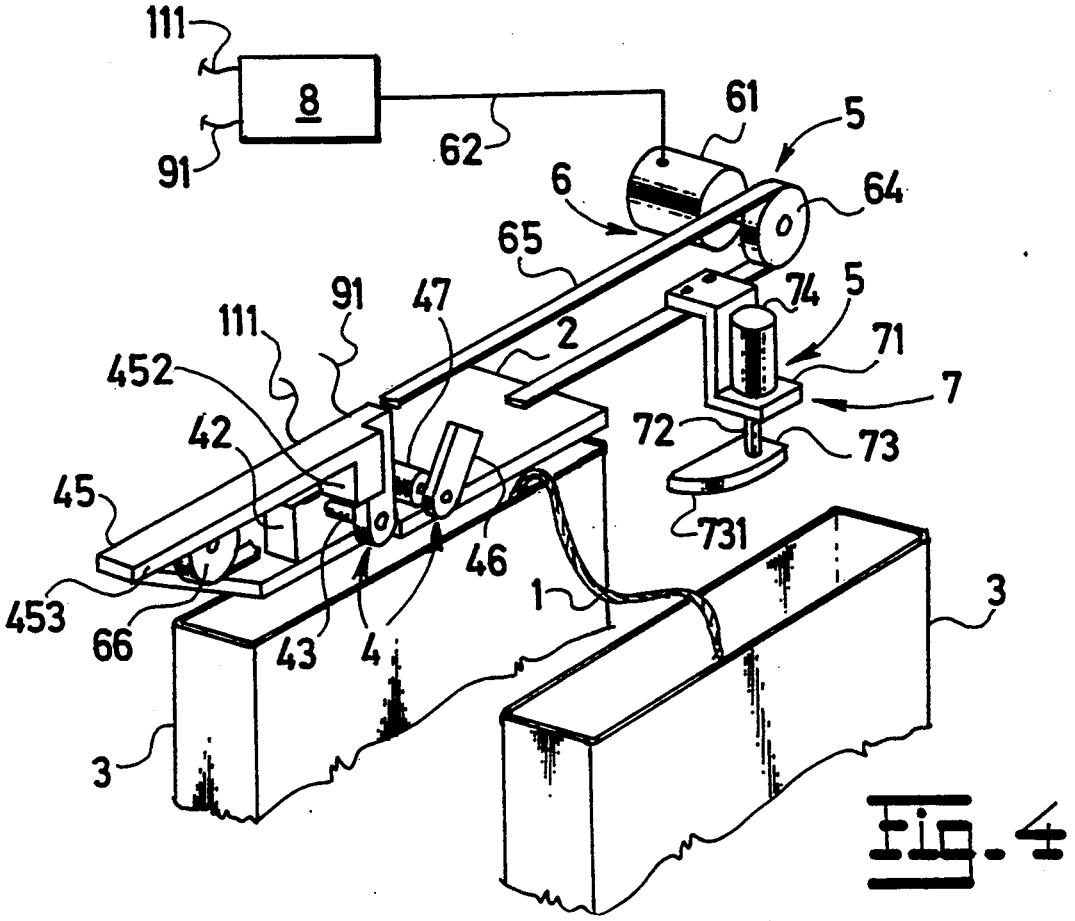
FIG. 4 is an axonometric view of a second embodiment of the device at the stage after the exchange of the cans but before the start of the operation.

In the embodiment shown in FIGS. 1 to 3, the holding device 4 comprises a holding plate 41 which is fixed to the side wall 21 of the sliver coiling device 2. The body of the sliver coiling device 2 also carries a drive mechanism 42 having an output shaft 43 which is fixed to a holding lever 44. That lever has an operating surface 441 which, in its operating position, extends parallel to the operating surface of the holding plate 41 and bears upon it. The drive mechanism 42 generates reversible rotary motion of the holding lever 44 between its operative and its non-operative positions. The holding lever 44 passes, i.e. swings, through the gap between the full non-circular can 3 which is replaced by the non-circular can 3 positioned under the can coiler of the sliver coiling device 2 that has just begun to receive the sliver.

A sliver grasping device 5 is mounted on the frame 21 of the sliver coiling device 2. The grasping device comprises a reversibly moveable conveyor 5 having a gripper 7 fixed to it. The conveyor 6 comprises a reversing motor 61 whose power supply 62 is connected with a control device 8. On the shaft 63 of the reversing motor 61 there is fixed a driving pulley 64 which is wrapped by a belt 65 or by another transport member. The belt 65 preferably lies in a plane parallel with the parallel axis plane 31 of the non-circular can 3. A driven pulley 66 is fixed on the opposite side of the frame 21 of the sliver coiling device 2 in a known manner. It is also wrapped by the belt 65. The body 71 of the gripper is fixed on the belt 65. For reliable functioning of the device, the body 71 of the gripper 7 is also preferably mounted in a known manner on a part of the frame 21 of the sliver coiling device 2 for guiding it. A tie rod 72 is slidingly mounted on the body 71 of the gripper 7. At the outward extremity of the rod there is a clip 73. The tie rod 72 is connected with the piston of a pneumatic cylinder 74. A feeler 75 is seated on the body of the gripper 7 for registering the presence of the sliver 1 in the gripper 7 by means of a cable 76 connected to the control device 8. The pneumatic cylinder 74 is connected to a pressure air supply in a known manner.

The reversibly moving conveyor 6 can alternatively comprise a different device having at least one part that moves reversibly in a line, e.g., by an ancillary pneumatic cylinder having a piston rod on which the body 71 of the gripper 7 is seated.

When the non-circular can 3 is completely filled with the sliver 1, it is displaced, and an empty non-circular can 3 is put in its place. This exchange of the non-circular cans 3 goes on without interruption of the sliver coiling process. As a result, there is an uninterrupted freely hanging sliver 1 between the displaced full non-circular can 3 and the other non-circular can 3 which is situated under the sliver coiling device 2 and is beginning to receive the sliver 1. After the replacement of one non-circular can 3 with another, the control device 8 sends out an instruction to start the drive mechanism 42. This turns the holding lever 44 in the direction toward the holding plate 41. During this turning motion, the holding lever 44 takes up the sliver 1 that hangs freely in the gap between the non-circular cans and presses upon the sliver with its operating surface 441 against the holding plate 41 above it. The motion of the holding lever 44 and of the drive mechanism 42 stops. After this operation, a part of the sliver 1 hangs vertically down over the edge of the holding lever 44. Next, an instruction from the control device 8 starts the reversing motor 61 of the conveyor 6 turning the driving pulley 64, and the open gripper 7 is transferred, due to the motion of the belt 65, from the driven pulley 66 to the driving pulley 64. In the course of this motion, the clip 73 of the gripper 7 is pushed out so as to come to lie under the holding lever. At the moment when the feeler 75 registers the presence of the sliver 1 in the gripper 7 and sends out the signal indicating that the presence of the sliver has been detected, the control device 8 instructs the pneumatic cylinder 74 to move the tie rod 72 with the clip 73 toward the body 71 of the gripper 7. The clip 73 presses the sliver 1 to the body of the gripper and grips it, as shown in FIG. 2. The belt 65 with the gripper 7 continues its movement, thus severing the sliver 1 between the points of gripping by the holding device 4 and the gripper 7. A first free end 101 of the sliver 1 remains gripped in the gripper 7 which continues its movement and transports the first free end 101 to the place of its subsequent handling or to another predetermined spot along its path where this first free end 101 of the sliver 1 is freed from the grip of the gripper 7. Then the rotation direction of the reversing motor 61 changes, the gripper 7 returns to its initial position and prepares for the next cycle of operation. The other free end 102 of the sliver, gripped at the moment of severing in the holding device 4, is then released due to the tilting away of the holding lever 44 from the plate 41 and back to its initial position, and the sliver end 102 is then drawn into the sliver receiving non-circular can 3.

In the alternative embodiment shown in FIGS. 4 to 7, the frame of the sliver coiling device 2 carries a holding device 4 for the sliver 1, comprising a drive mechanism 42 having a searching lever 45 fixed on its output shaft 43 which lever 45 is fitted with an operating surface 451 which can come into contact with the sliver 1. The operating surface 451 of the searching lever 45 has a contact surface 452 at its end. In the operating position of the searching lever 45 in its holding position an ancillary lever 46 bears against the contact surface 452. The lever 46 is coupled with a reversing drive 47 of the ancillary lever which is mounted on the frame 21 of the sliver coiling device and is coupled with the control device 8.

Similarly to the previous embodiment, the gripper 7 is fixed on the belt 65 of the conveyor 6. The gripper 7 has a body 71 on which the pneumatic cylinder 74 is vertically mounted. The piston of that cylinder is connected with the tie rod 72 and has the clip 73 at its extremity. In the inactive position of the tie rod 72 of the gripper 7, the clip 73 is below the searching lever 45 in its operating position, or at least it is below the operating surface 451 of the searching lever 45.

Two feelers 9, 10 for registering the position of the gripper 7 are disposed next to the path of the gripper 7 and are mounted on the block of the sliver coiling device 2. At least one feeler is mounted adjustably. The feelers 9, 10 are connected with the control device 8 by means of lines 91, 111.

A not represented ancillary tilting lever acts with reference to the searching lever 45. it is mounted in similar way to the opposite side of the frame and moves opposite the direction of the movement of the searching lever 45.

Figure 5:
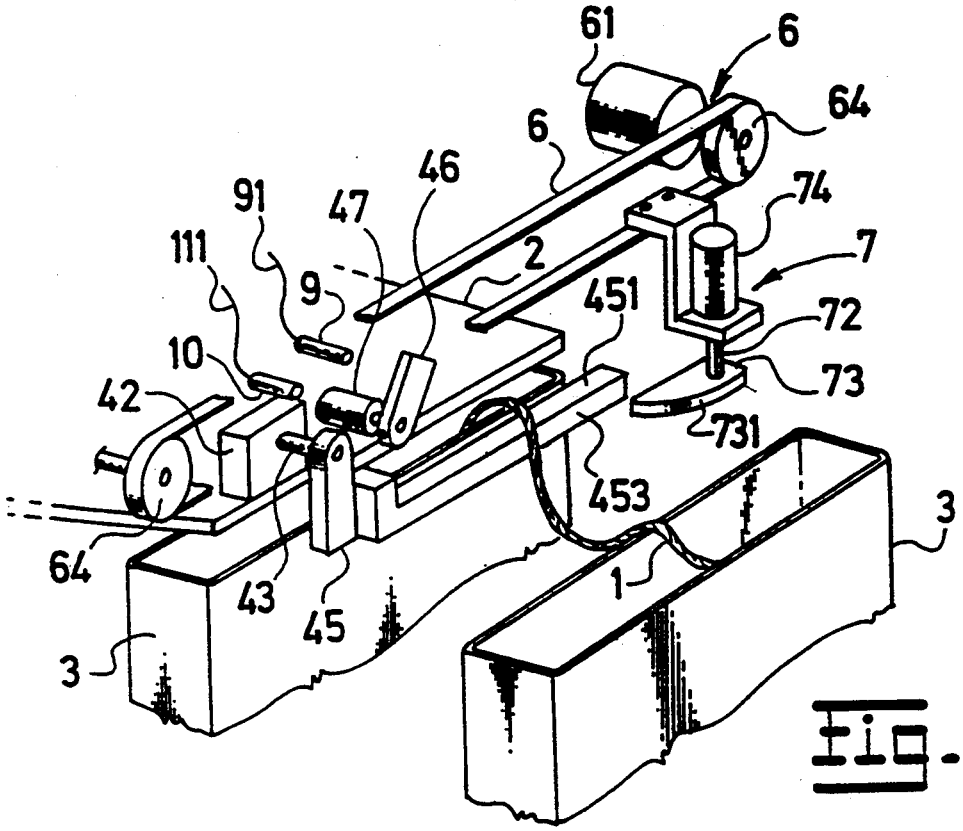
FIG. 5 is a view of the device according to FIG. 4 with the searching lever in its active or operating position.
Figure 6:
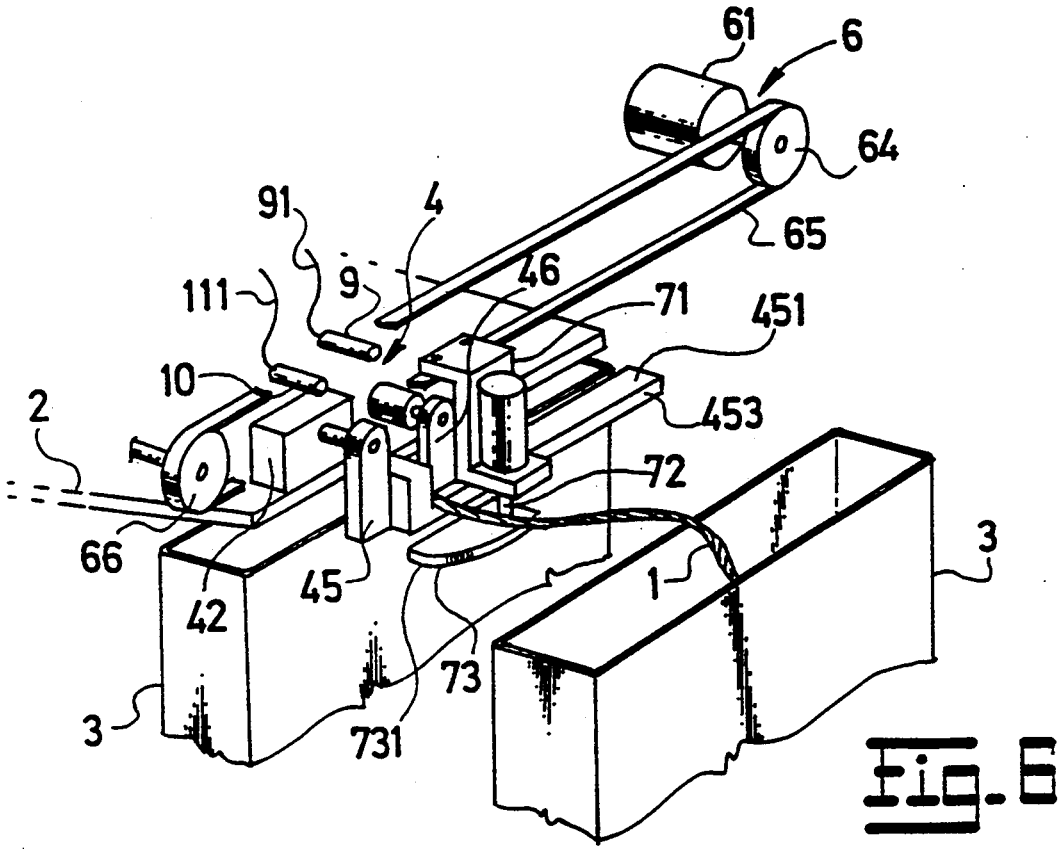
FIG. 6 is a view of the device according to FIG. 5 at a subsequent stage in which the sliver is transferred to the contact surface of the searching lever and gripped by the ancillary lever.
Figure 7:
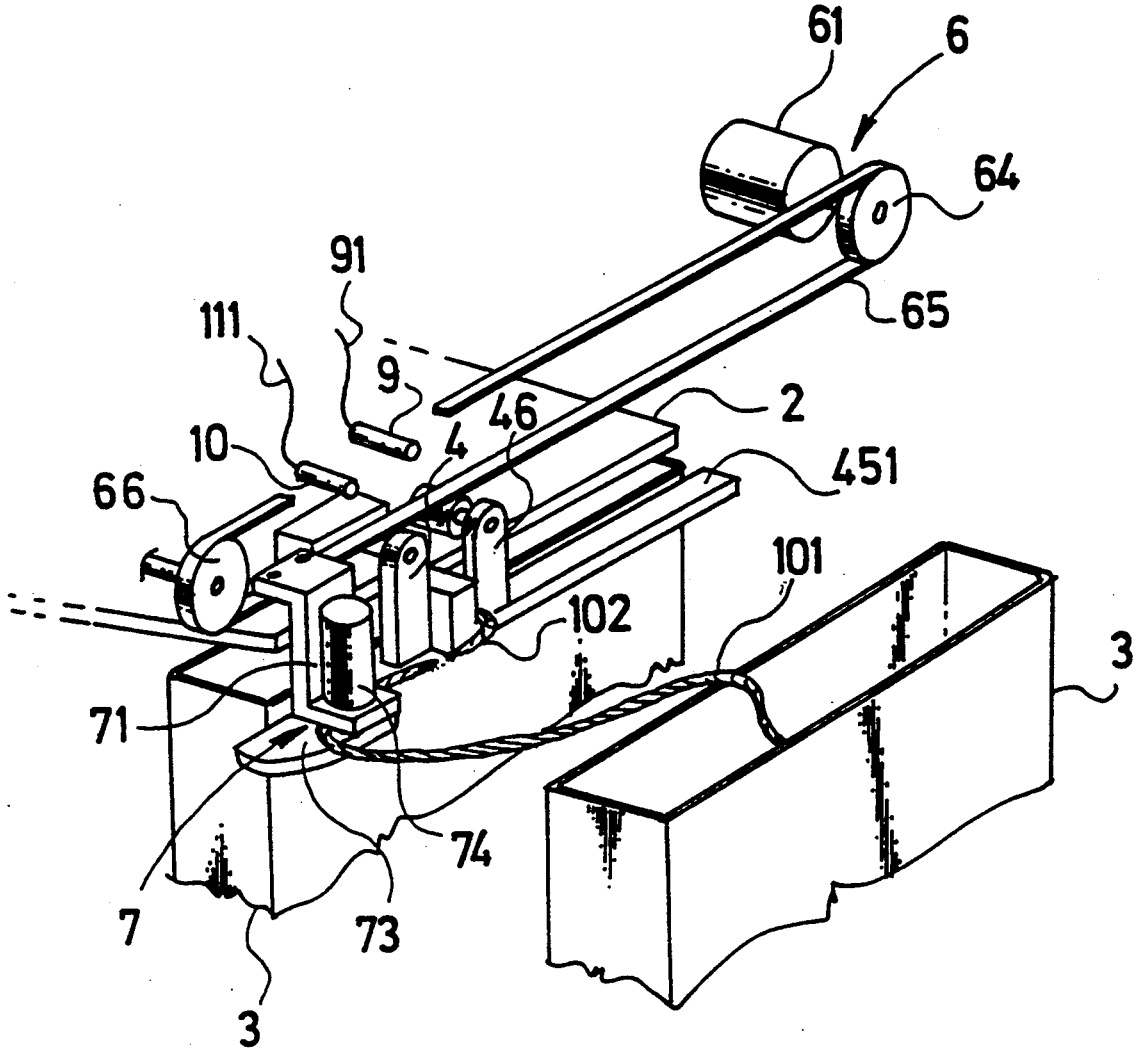
FIG. 7 is the device according to FIG. 6 in the final stage, after the sliver has been severed.

After the exchange of the non-circular cans 3 is begun, the drive mechanism 42 turns the searching lever 45 to its operating position shown in FIG. 5. During its movement in the counterclockwise direction in FIG. 5, in the gap between the full non-circular can 3, which has just been transferred aside, and the non-circular can 3 which is just beginning to receive the sliver, the searching lever 45 takes up the sliver 1 that is freely hanging between the non-circular cans 3. In the operating position of the searching lever 45, the sliver 1 lies freely on the operating surface 451 and hangs downward over its outer side wall 453.

When the operating position of the searching lever 45 has been reached, the control device 8 sets in motion the reversing motor 61 of the conveyor 6. The belt 65 together with the gripper 7 starts moving toward the operating surface 452 of the searching lever 45. During its motion along the searching lever 45, the clip 73 of the gripper 7 takes up the sliver hanging from the operating surface 451 of the searching lever 45. Since the run-up surface 731 of the clip 73 is chamfered or rounded in the direction away from the searching lever 45, the clip 73 transfers the taken up sliver 1 on it up to the tie rod 72. During the subsequent movement of the gripper 7, the sliver 1 moves on the operating surface 451 of the searching lever 45 up to the operating or contact surface 452 of the searching lever 45. At this moment, the first feeler 9 registers the position of the gripper 7 and sends out a signal instructing the control device 8 to start the reversing drive 47 of the ancillary lever 46. That lever begins then to turn until it reaches the position at which it presses the sliver 1 onto the operating contact surface 452 of the searching lever 45. The gripper 7 continues its movement, and the sliver 1 slides on the clip 73 and on the tie rod of the gripper 7 thus increasing the distance between the two gripping points of the sliver 1, i.e., that carried out by the ancillary lever 46 and that effected by the gripper 7.

The other feeler 10 registers the position of the gripper 7 and sends out a signal when the length of the sliver 1 between the two gripping points has reached a predetermined value. Based on the signal of the second feeler 10, the control device 8 activates the pneumatic cylinder 74 of the gripper 7 so as to move the tie rod 72 and press the clip 73 against the body 71 of the gripper 7, thus gripping the sliver 1. During the subsequent movement of the gripper 7, the sliver 1 is severed. After this, the gripper 7 transports the first free end 101 of the sliver 1 to a predetermined position where the first free end 101 is either released or handed over to the following, not shown, handling device, whereupon the gripper 7 returns to its initial position. Also the ancillary lever 46 turns to its initial position and releases the second free end 102 of the sliver 1, which is then drawn into the sliver receiving non-circular can 3. The searching lever 45 tilts away to its initial position, and the whole device is ready for the next cycle.

By changing the position of the second feeler 10, which registers the position of the gripper 7, it is possible to adjust the required severing length according to the staple fiber length so that all free sliver ends of the full non-circular cans 3 are equal. This is important for the further handling of the sliver 1 to be inserted into the spinning unit of a not represented open end spinning machine.

The two alternative embodiments of the device for severing the sliver in a filling station after the replacement of the full can by an empty one can be used also in a filling station in which the sliver is coiled into circular cans. The orientation of the cans is immaterial. It is only necessary to provide a gap sufficient for passage of the holding or searching lever between the full can and the empty one.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. At a filling station of a sliver producing textile machine, a severing device for severing the sliver at the replacement of a full can with a can to be filled; the filling station comprising a sliver coiling device and means supporting both a full can and a can to replace the full can and to be filled, and the filled and to be filled cans being positioned with a gap between them on the supporting means;

the severing device being in the vicinity of the coiling device for the sliver and generally over the gap between the filled can and the can to be filled which is to receive the sliver; the severing device comprising:

a holding device for holding the sliver;

a grasping device for grasping the sliver at the location spaced from the holding device, the grasping device being mounted in a manner to move with respect to the holding device for causing the severing of the sliver into a first end and a second end due to the movement of the grasping device with reference to the holding device; wherein upon severing of the sliver, the grasping device is movable to a release position where the grasping device releases the first end and the holding device is operable to hold the second end so that a portion of sliver located between the sliver producing textile machine and the holding device is unsupported and to release the second end so that the second end is deposited directly in the can to be filled which is then in a position to receive the released second end.

2. The device of claim 1, further comprising means supporting the grasping device for reversible movement on the coiling device and with reference to the holding device, for movement to the position for severing the sliver and for reverse movement.

3. The device of claim 2, wherein the holding device comprises a holding plate which is fixed at the coiling device and a holding lever supported on the holding plate, the holding lever being mounted for reversible rotation with respect to the sliver coiling device, and being rotatable to a position to clamp the sliver between the holding lever and the holding plate and away from such clamping position.

4. The device of claim 3, wherein the grasping device comprises a gripper mounted on the sliver coiling device for reversibly moving between a gripping and a releasing position, the gripper being provided with a feeler for registering the presence of the sliver at the gripper and the feeler being connected for moving the gripper to the gripping position.

5. The device of claim 2, wherein the holding device comprises a searching lever mounted for reversible rotation on the coiling device, the searching lever having an operating surface with a contact surface at one extremity of the operating surface;

an ancillary lever mounted on the sliver coiling device and being moveable to contact the contact surface of the reversibly rotatable searching lever and by such contact to hold the sliver.

6. The device of claim 5, wherein the grasping device comprises a gripper mounted on the sliver coiling device for reversibly moving between a gripping and a releasing position, the gripper being provided with two feelers which are spaced apart for registering the position of the gripper as it moves with reference to the holding device and for causing operation of the gripper to grasp the sliver.

7. The device of claim 1, wherein the grasping device comprises a gripper mounted on the sliver coiling device for reversibly moving between a gripping and a releasing position, the gripper being provided with a feeler for registering the presence of the sliver at the gripper and the feeler being connected for moving the gripper to the gripping position.

8. The device of claim 7, further comprising a conveyor on which the gripper is mounted and a reversing motor connected with the conveyor for reversing the motion of the conveyor and thereby of the gripper.

9. The device of claim 8, wherein the gripper comprises a body, a tie rod slidingly inserted in the body and having a clip at the extremity of the tie rod for engaging the sliver, and pneumatic cylinder means for moving the tie rod to selectively cause the clip to engage and hold the sliver and to disengage and release the sliver.

10. The device of claim 1, wherein the grasping device comprises a gripper mounted on the sliver coiling device for reversibly moving between a gripping and a releasing position, the gripper being provided with two feelers which are spaced apart for registering the position of the gripper as it moves with reference to the holding device and for causing operation of the gripper to grasp the sliver.

11. The device of claim 10, further comprising a conveyor on which the gripper is mounted and a reversing motor connected with the conveyor for reversing the motion of the conveyor and thereby of the gripper.

12. At a filling station of a sliver producing textile machine, a severing device for severing the sliver at the replacement of a full can with a can to be filled; the filling station comprising a sliver coiling device and means supporting both a full can and a can to replace the full can and to be filled, and the filled and to be filled cans being positioned with a gap between them on the supporting means;

the severing device being in the vicinity of the coiling device for the sliver and generally over the gap between the filled can and the can to be filled which is to receive the sliver; the severing device comprising:

a holding device for holding the sliver, the holding device comprising a searching lever mounted for reversible rotation on the coiling device, the searching lever having an operating surface with a contact surface at one extremity of the operating surface;

a grasping device for grasping the sliver at the location spaced from the holding device, the grasping device being mounted in a manner to move with respect to the holding device for causing the severing of the sliver due to the movement of the grasping device with reference to the holding device;

means supporting the grasping device for reversible movement on the coiling device and with reference to the holding device, for movement of the position for severing the sliver and for reverse movement; and an ancillary lever mounted on the sliver coiling device and being moveable to contact the contact surface of the reversibly rotatable searching lever and by such contact to hold the sliver.

13. The device of claim 12, wherein the grasping device comprises a gripper mounted on the sliver coiling device for reversibly moving between a gripping and a releasing position, the gripper being provided with two feelers which are spaced apart for registering the position of the gripper as it moves with reference to the holding device and for causing operation of the gripper to grasp the sliver.

14. At a filling station of a sliver producing textile machine, a severing device for severing the sliver at the replacement of a full can with a can to be filled; the filling station comprising a sliver coiling device and means supporting both a full can and a can to replace the full can and to be filled, and the filled and to be filled cans being positioned with a gap between them on the supporting means;

the severing device being in the vicinity of the coiling device for the sliver and generally over the gap between the filled can and the can to be filled which is to receive the sliver; the severing device comprising:

a holding device for holding the sliver;

a grasping device for grasping the sliver at the location spaced from the holding device, the grasping device being mounted in a manner to move with respect to the holding device for causing the severing of the sliver due to the movement of the grasping device with reference to the holding device, the grasping device comprising a gripper mounted on the sliver coiling device for reversibly moving between a gripping and a releasing position, the gripper being provided with a feeler for registering the presence of the sliver at the gripper and the feeler being connected for moving the gripper to the gripping position; and a conveyor on which the gripper is mounted and a reversing motor connected with the conveyor for reversing the motion of the conveyor and thereby of the gripper;

wherein the gripper comprises a body, a tie rod slidingly inserted in the body and having a clip at the extremity of the tie rod for engaging the sliver, and pneumatic cylinder means for moving the tie rod to selectively cause the clip to engage and hold the sliver and to disengage and release the sliver.

* * * * *